US005095683A

United States Patent [19]

Roberts et al.

[11] Patent Number: 5,095,683

[45] Date of Patent: Mar. 17, 1992

[54] CONTINUOUS MOTION PACKAGE ASSEMBLING APPARATUS

[75] Inventors: John T. Roberts, Clover; Claude E. Monsees, Ft. Mill, both of S.C.; Larry J. Mattson, Charlotte, N.C.; Ralph S. Goldstein, Lake Wylie, S.C.; Ronald H. Wanless, Lebanon, Ohio; Ronald O. Simpson, Charlotte, N.C.

[73] Assignee: The Procter & Gamble Company, Cincinnati, Ohio

[21] Appl. No.: 670,723

[22] Filed: Mar. 18, 1991

Related U.S. Application Data

[63] Continuation-in-part of Ser. No. 566,159, Aug. 9, 1990.

[51] Int. Cl.[5] ..... B65B 61/14

[52] U.S. Cl. ..... 53/413; 53/134.1; 53/170; 53/449; 493/96; 493/88; 493/909

[58] Field of Search ..... 53/413, 134.1, 449, 53/175, 170; 493/88, 909, 96

[56] References Cited

U.S. PATENT DOCUMENTS 3,204,386 9/1965 Creed et al. ..... 53/134.1 X
3,412,651 11/1968 Thibault ..... 493/88
3,834,970 9/1974 Mitsuoka et al. ..... 493/909 X
4,616,467 10/1986 Brain et al. ..... 493/88 X
4,716,707 1/1988 Gambetti ..... 53/134.1

*Primary Examiner*—James F. Coan

[57] ABSTRACT

An apparatus and process for the assembly of a bayonet handle package are provided. The apparatus comprises at least one handle gripping and insertion wheel mounted on a horizontal rotatable shaft and further comprises means for driving the shaft. The wheel carries a plurality of evenly-spaced, circumferentially mounted handle clamping and insertion assemblages. The assemblages operate cyclically—that is, depending upon the assemblage position in the 360 degree rotational cycle of the wheel—to grip, bend and release the handles.

The process of the invention contemplates first providing an apparatus as described. Second, the wheel begins continuous rotation to effectuate the cyclical operation of the gripping and bending assemblages. A handle is then positioned at a first location near the wheel where it is gripped by one of the rotating assemblages. The further rotation of the wheel operates the rotating assemblage to bend the handle such that the barb heads are inserted into handle insertion apertures formed in an appropriately placed carton blank. Attachment of the handle to the carton blank is thereby accomplished, facilitating package assembly.

16 Claims, 8 Drawing Sheets

CONTINUOUS MOTION PACKAGE ASSEMBLING APPARATUS

CROSS REFERENCE TO RELATED APPLICATIONS

This application is a Continuation-In-Part of application Ser. No. 07/566,159, filed Aug. 9, 1990.

BACKGROUND OF THE INVENTION

This invention relates generally to the art of packaging and more particularly to an apparatus and process for the assembly of a package having a bayonet carrying handle.

The bayonet handle package, described in pending U.S. patent application, Ser. No. 07/566,159, filed Aug. 9, 1990 and incorporated herein by reference, is a recent development which is superior to prior art handled packages in virtually every respect. One of the primary advantages of the bayonet handle package is the suitability of the bayonet handle itself to high speed mating with a carton blank.

Prior art handles, which are still seen in the marketplace, are generally attached to the carton blank by riveting. The riveting process, however, is slow and prone to frequent failure. This greatly increases the cost of the package to the eventual consumer.

The bayonet handle, on the other hand, is folded and inserted into apertures on the carton blank such that barbs on the ends of the handle are ensnared on the aperture lip. Attachment is therefore accomplished by the combination of the aperture and the shape of the handle. Since the need for a rivet and its concomitant attachment process is eliminated, the bayonet handle inherently lends itself to increased attachment speeds. The machinery, however, necessary to fully exploit the advantages of the bayonet handle design has not appeared in the prior art.

SUMMARY OF THE INVENTION

It is thus an object of this invention to provide an apparatus to facilitate the attachment of an elongated bayonet handle to a carton blank.

It is a further object of the invention to provide a continuous motion apparatus for the attachment of an elongated bayonet handle to a carton blank.

It is a further and more particular object of the invention to provide a high-speed continuous motion apparatus for the assembly of a package having a bayonet carrying handle.

It is also an object of the invention to provide a novel process for the insertion of an elongated bayonet handle having barb heads defining respective ends thereof to a carton blank having a pair of handle insertion apertures.

Some of these, as well as other, objects are accomplished by an apparatus for releasably gripping and bending an elongated bayonet handle having a barb head on each end. The gripping and bending of the handle facilitates insertion of the barb heads into handle insertion apertures defined by the carton blank. Attachment of the handle to the blank is thereby accomplished.

The apparatus comprises a handle gripping and insertion wheel mounted on a horizontal rotatable shaft and further comprises means for driving the shaft. The wheel carries a plurality of evenly-spaced, circumferentially mounted handle clamping and insertion assemblages. The assemblages operate cyclically—that is, depending upon the assemblage position in the 360 degree rotational cycle of the wheel—to grip, bend and release the handles.

The process of the invention contemplates first providing an apparatus as described. Second, the wheel begins continuous rotation to effectuate the cyclical operation of the gripping and bending assemblages. A handle is then positioned at a first location near the wheel where it is gripped by one of the rotating assemblages. The further rotation of the wheel operates the rotating assemblage to bend the handle such that the barb heads are inserted into the handle insertion apertures of an appropriately placed carton blank. Attachment of the handle to the carton blank is thereby accomplished.

DETAILED DESCRIPTION

In accordance with this invention, it has ben found that a novel apparatus and method may be provided to facilitate the attachment of an elongated bayonet handle to a carton blank. The apparatus functions to automatically grip and bend an appropriately positioned handle whereby barb heads defining each end of the handle may be inserted into handle insertion apertures formed in the carton blank. Thus, handle attachment is accomplished at speeds and with efficiency heretofore unattainable.

The bayonet handle package generally comprises there separate components: the carton blank, the liner and the bayonet handle. Once these components have been assembled, well known machines are available to fold and glue the package into its final boxlike form. These folder/gluers can operate at considerable speeds—over four hundred packages per minute. Prior to this invention, means have not been available to assemble the packages at rates comparable to the folder/gluers.

Figure 1:
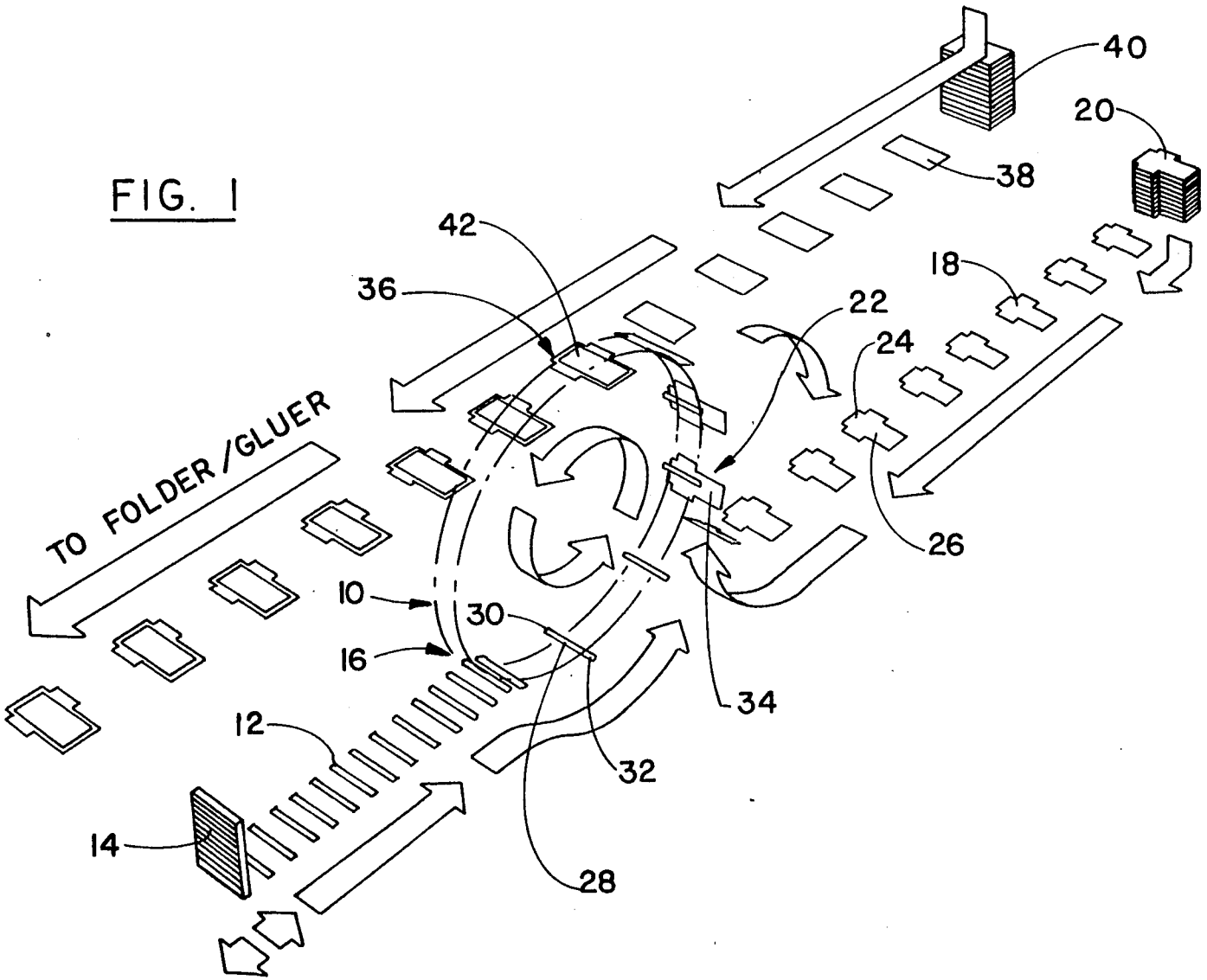
FIG. 1 is a perspective schematic illustration in simplified form of the assembly of various component parts into a bayonet handle package which is ready to enter a folder/gluer device.

FIG. 1 illustrates in simplified form the component assembly function of the invention. Component assembly is largely effectuated by the rotating action of handle gripping and insertion apparatus 10. As shown by the directional arrows, the three components are singularly and continuously conveyed to different locations near apparatus 10 as it rotates. Apparatus 10 facilitates assembly of the components s that the assembled package may be received by a folder/gluer (not shown).

Specifically, handles 12, individually sheared from the bottom of handle cartridge 14, are delivered in seriatim to a first location 16, which is proximate and tangent to apparatus 10. Similarly, carton blanks 18 are delivered in seriatim from carton blank source 20 to a second location 22, also proximate and tangent to apparatus 10. The formation of handle insertion apertures, such as 24 and 26, is typically completed at a point during delivery from source 20 to location 22. The apertures are partially formed at the time of blank manufacture by perforating a small disc in the blank material. Thus, aperture formation may be completed at this stage by simply removing the disc, or "slug."

Handles, such as shown at 28, that have been received by apparatus 10, are carried to location 22 to arrive in tandem with the blanks. Subsequently, barb heads, illustrated at 30 and 32 of handle 28, are inserted through the handle insertion apertures, thus attaching a handle to a blank, such as blank 34.

As the apparatus 10 continues to rotate, it carries the handle and attached blank to a third location 36. Simultaneously, container liners 38 are conveyed in seriatim from liner source 40. At location 36, a liner 42 converges upon the blank and is attached thereto by hot glue or other adhesive. The barb heads are thus retained and the package assembly is complete. Assembled packages are then carried to the folder/gluer. During this time, the glue will "set."

Figure 2:
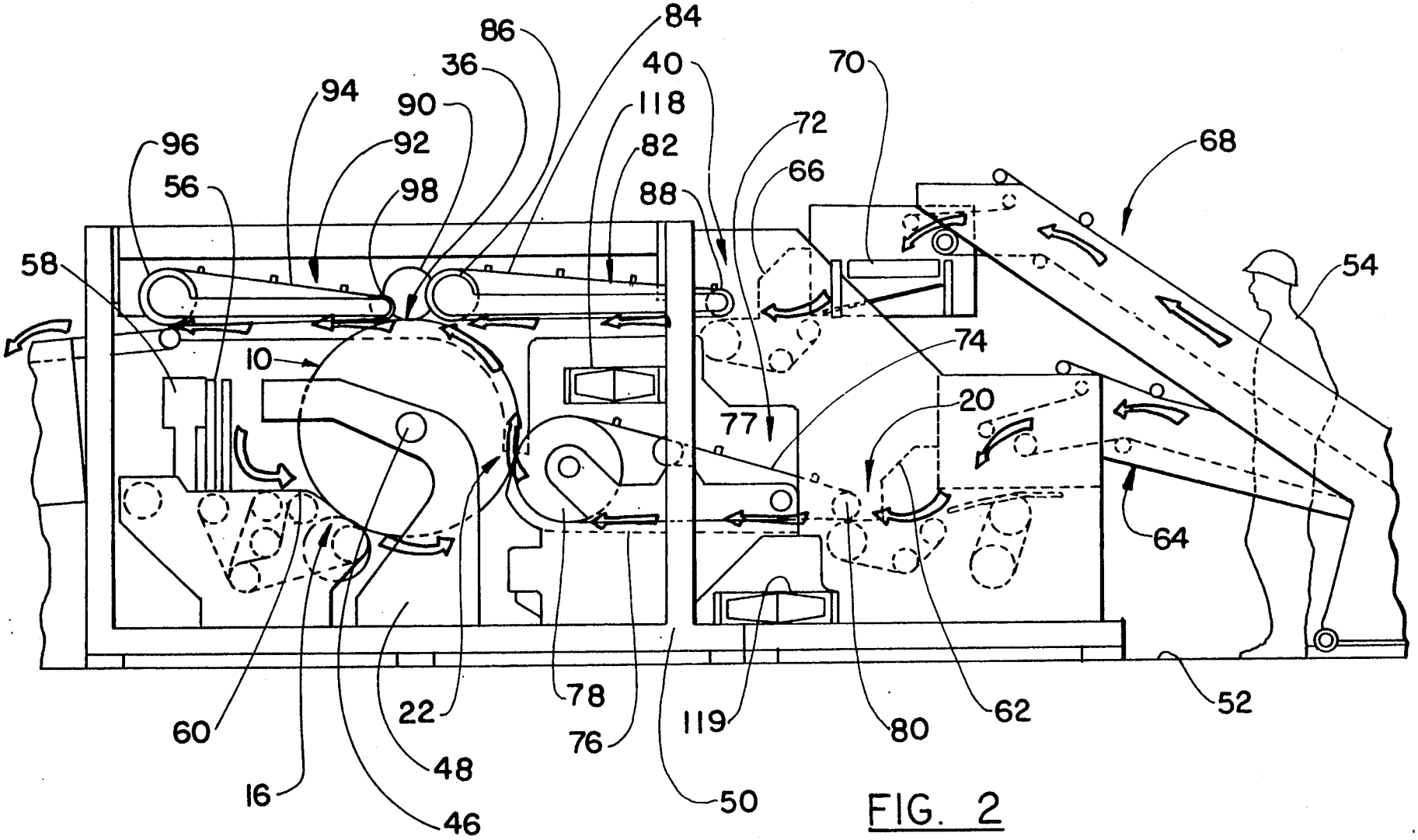
FIG. 2 is a side elevation view of the continuous motion apparatus of the invention wherein some of the more significant internal components are illustrated in phantom.

As seen in FIG. 2, apparatus 10 comprises at least one wheel maintained on rotatable shaft 46. Shaft 46, in turn, is horizontally mounted on frame 48, supported by subframe 50, which rests on floor 52. Operator 54, who is depicted as being six feet in height, is shown for purposes of reference.

Handle cartridges 14 (FIG. 1) are carried to handle dispenser 56 via lateral conveyor 58. Handle dispenser 56 shears the handles from the bottom of cartridge 14. Thereafter, handle conveyor 60 singularly carries the handles 12 (FIG. 1) to location 16. U.S. Pat. Nos. 4,946,536; 4,854,931; 4,832,537; 4,811,861; and 4,662,974 illustrate means for dispensing and conveying thermoplastic articles, such as bayonet handles, from a fused cartridge. The above listed U.S. Patents are hereby incorporated by reference into this disclosure.

Carton blank source 20 comprises carton feeder 62, which is generally automatically loaded by a prefeeder, such as that shown at 64. Similarly, liner source 40 comprises liner feeder 66. Liner feeder 66, like carton feeder 62, is also automatically loaded. This loading is accomplished by prefeeder 68 and lateral liner conveyor 70.

Carton blanks 18 (FIG. 1) are carried from carton feeder 62 to location 22 by a carton blank conveyor 72. In the preferred embodiment of the invention, conveyor 72 may comprise a carton blank delivery belt 74 or the like above a guide track, such as track 76. Belt 74 is wrapped continuously around guide wheel 78 and idler wheel 80. Guide wheel 78 is the drive wheel. Track 76 supports the blanks as they are held and moved by lugs, such as lug 77, on belt 74. Track 76 is adapted such that it can be lowered away from belt 74. In this way, blanks which may occasionally become jammed can be easily removed.

Figure 4:
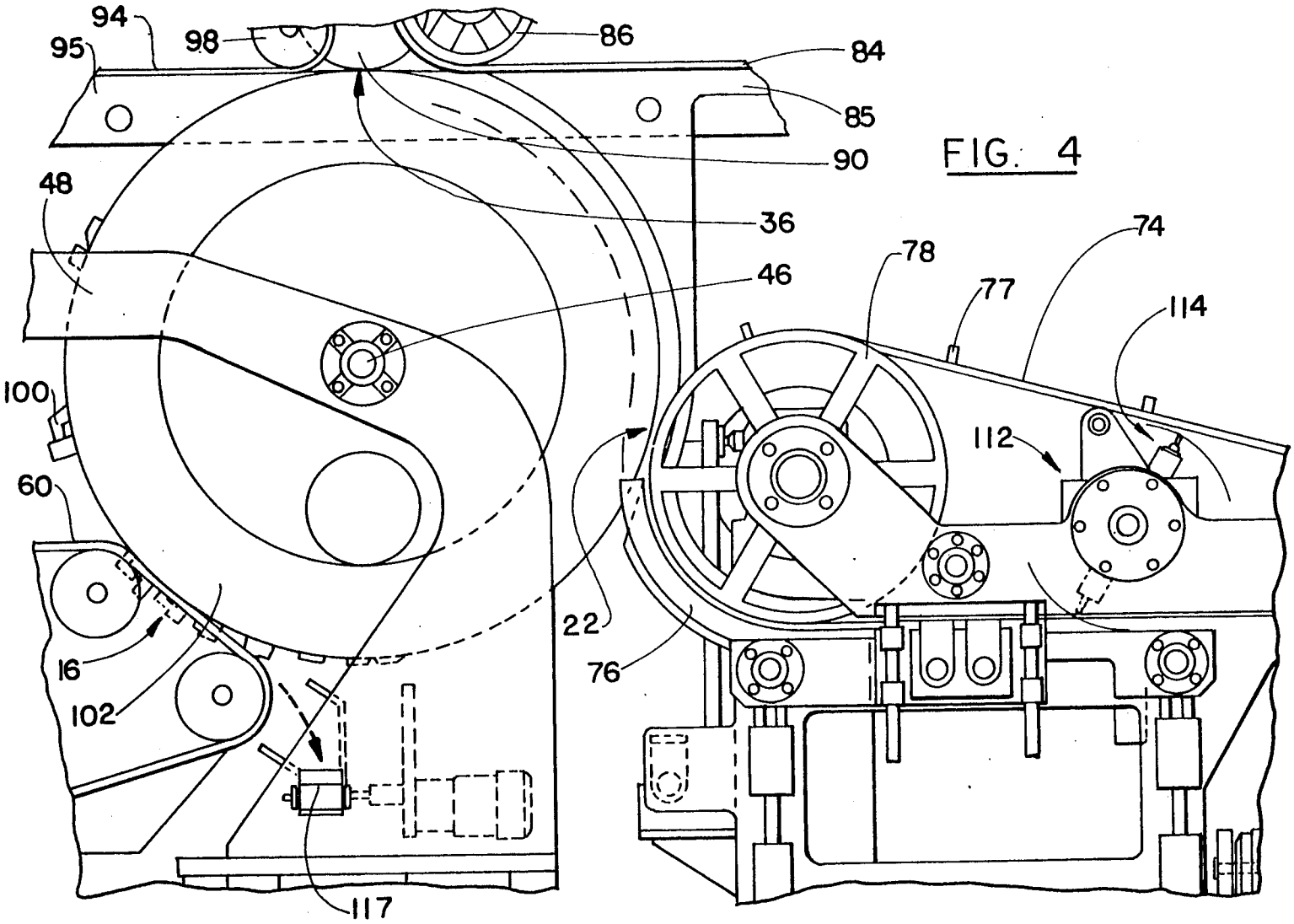
FIG. 4 is an enlarged partial elevation illustrating in detail the handle bending and tripping apparatus of the invention as well a other components facilitating high speed bayonet handle attachment.

In a similar manner, liners 38 (FIG. 1) are singularly and continuously transported to location 36 by a liner conveyor 82. Conveyor 82 may comprise a lugged liner delivery belt, such as 84, above a liner guide track 85 (FIG. 4). Belt 84 is wrapped continuously around drive wheel 86 and idler wheel 88. Glue-pressing wheel 90, which is above apparatus 10 and near location 36, firmly presses the liners onto the carton blanks. This facilitates the spreading and setting of the glue (which has been applied by means such as a glue gun at a location intermediate locations 22 and 36). The glue further sets as the assembled package is transported to the folder/gluer by package conveyor 92. In the preferred embodiment, conveyor 92 is similar to conveyor 82, having a lugged belt 94 above a cooperating package guide track 95 (FIG. 4). Belt 94 is wrapped around drive wheel 96 and idler wheel 98. Conveyors 82 and 92 and glue-pressing wheel 90 are raisable as a unit for jam clearing.

As has been shown, the system requires the delivery of three separate components to apparatus 10 with precision timing. It can be expected that occasionally one or more of the components will not arrive as desired. To prevent partially assembled packages from proceeding to the folder/gluer, it is desirable that, should proper delivery of one component fail, all three components be rejected and carried away. Thus, handle reject conveyor 117, liner reject conveyor 118 (FIG. 2), and carton blank reject conveyor 119 (FIG. 2) are provided.

Figure 3:
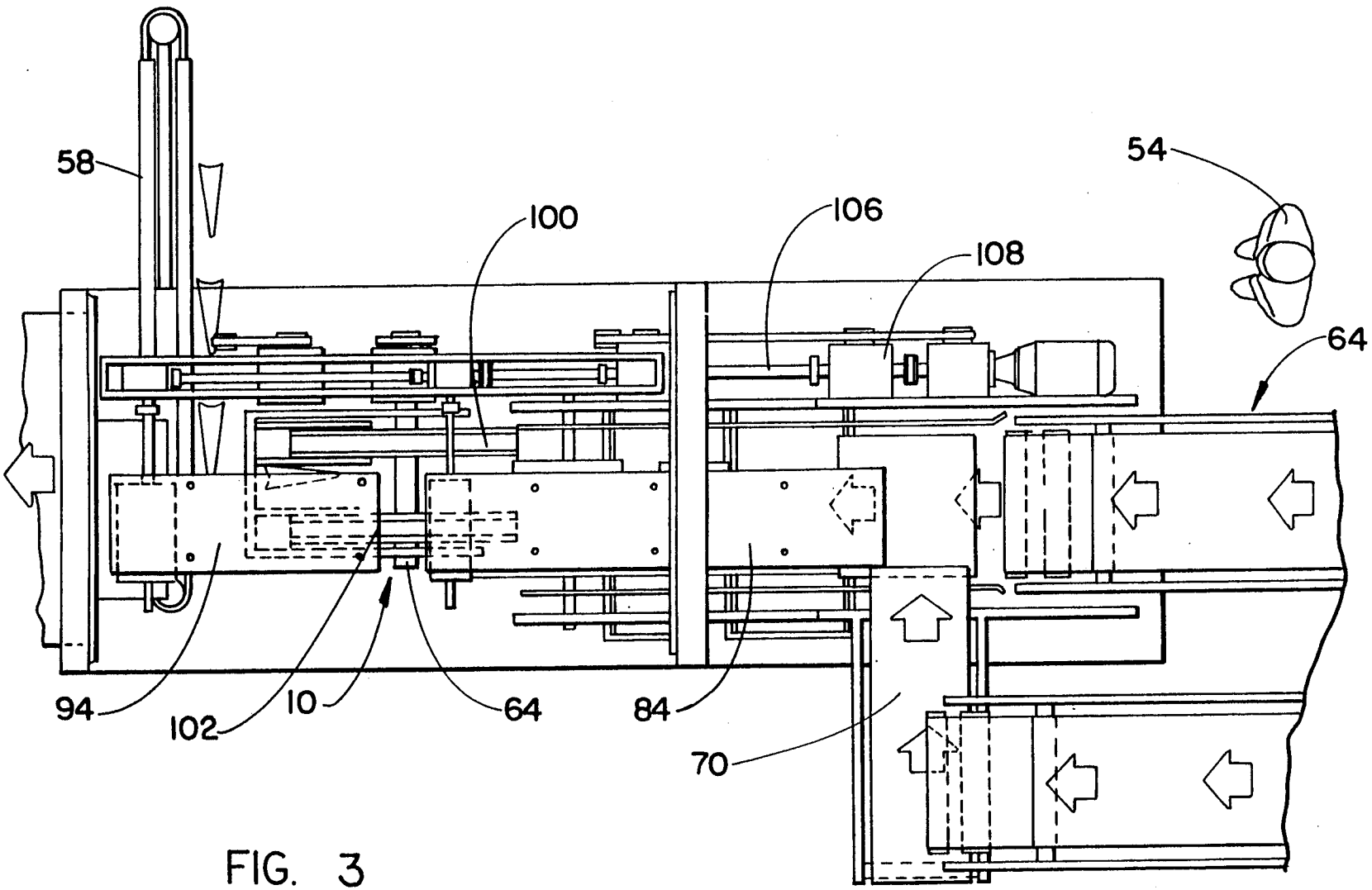
FIG. 3 is a partial plan view of the continuous motion apparatus of the invention.

Referring to FIG. 3, it can be seen that apparatus 10 typically comprises a pair of parallel wheels 100 and 102. The wheels 100 and 102 are spaced appropriately for the length of a particular handle. Typically, this spacing will be adjustable such that a wide variety of handle lengths may be accommodated. FIG. 3 also illustrates the apparatus main drive motor 104. Motor 104 is in mechanical communication with and thereby drives all of the movements within the apparatus. This linkage is provided by drive shafts, such as 106, and gear boxes, such as 108. Proper timing is accomplished through a combination of gear ratios, machine dimensions and control circuitry.

Apparatus 10 has circumferentially mounted and evenly spaced thereon a series of handle clamping and insertion assemblages. Best results have been obtained with six such assemblages. Each such assemblage comprises a pair of parallel handle grippers which grip the handles at an interior section inward of the barb heads. One gripper of each pair is located, respectively, on one of the parallel wheels 100 and 102. Wheels 100 and 102 have therein cams which actuate the grippers as the wheels rotate via shaft 46. Thus, the gripping, bending and insertion occurs in a continuous motion.

One gripper of each pair corresponds, respectively, to a single handle barb head. Each gripper is identical, except, of course, being in mirror image. As such, the function of a complete assemblage may be readily understood with reference to one gripper.

FIG. 4 illustrates the function of such a gripper 110, which is mounted on wheel 102. As shown, gripper 110 emerges from a recessed position to grip a handle arriving at location 16. Between location 16 and 22 the gripper again recesses. This action bends the barb head such that it projects axially away from the wheel. At location 22, gripper 110 begins to push the barb head through a properly aligned handle insertion aperture, which has previously been formed by rotary aperture punch mechanism 112. Punch peg pairs 114 and 116, mounted on mechanism 112, are timed to rotate into the carton blanks as they pass underneath, thereby removing the aperture "slug."

Figure 5:
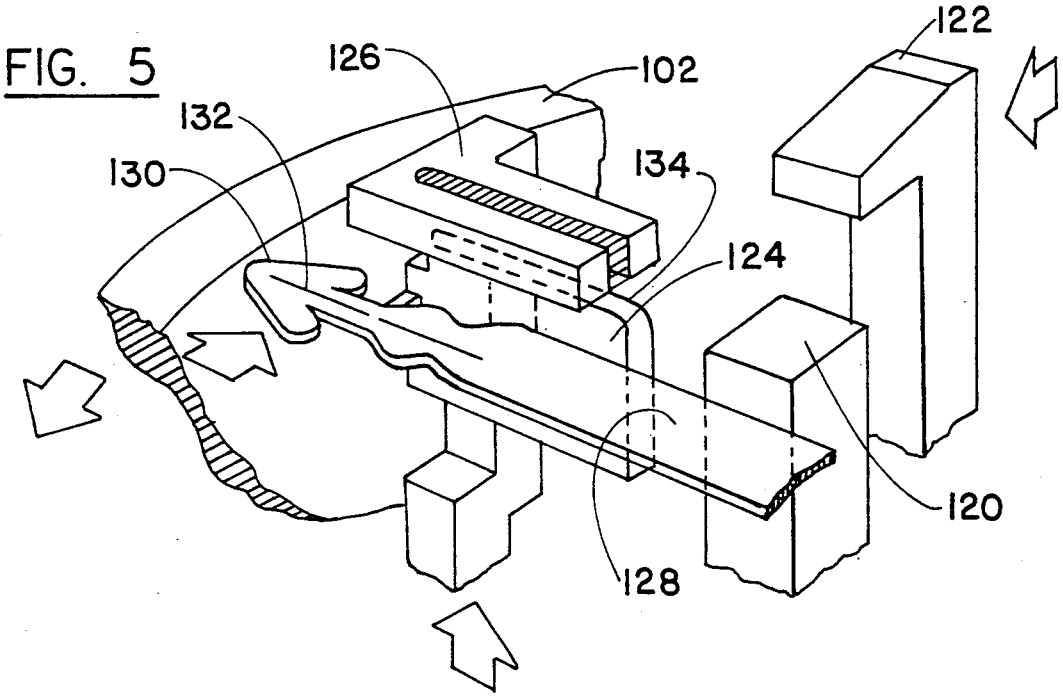
FIGS. 5 through 11 are sectional perspective views, partially in phantom, of a handle gripper constructed in accordance with the invention sequentially illustrating the gripper's cyclical operation.
Figure 6:
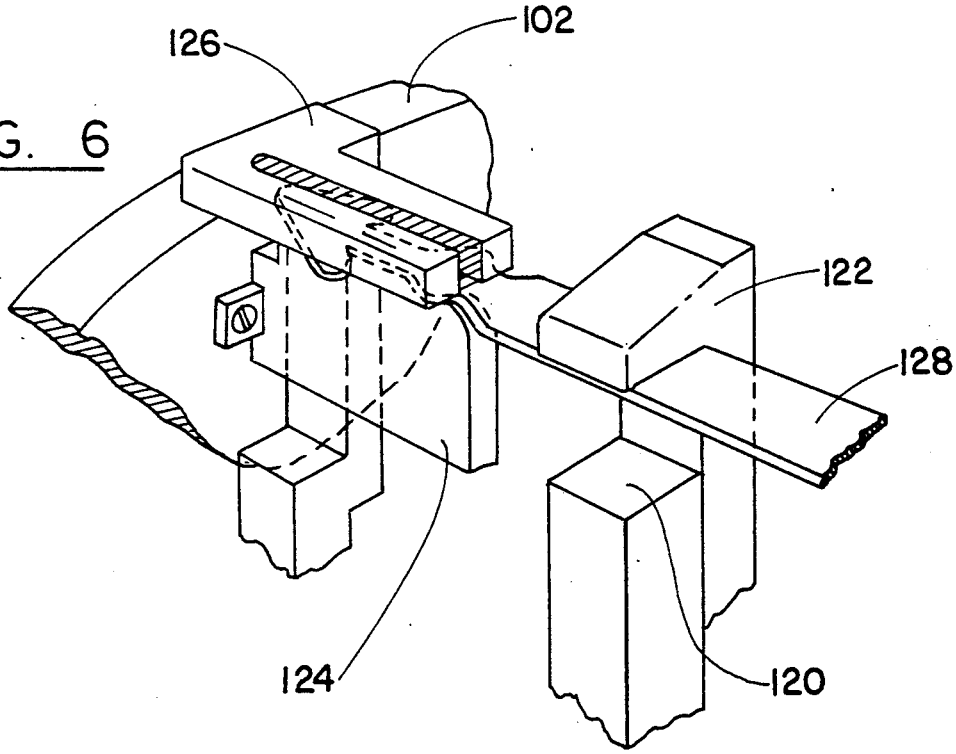
Figure 7:
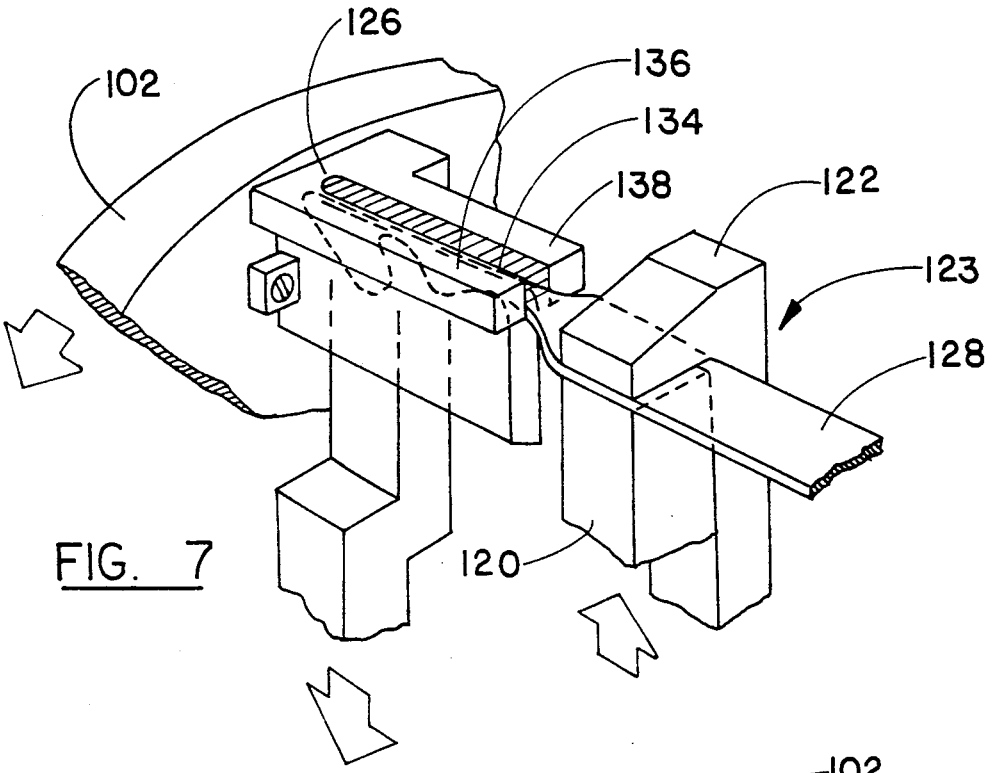

Referring to FIGS. 5 through 11, it can be seen that gripper 110 comprises clamping base 120, clamping arm 122, blade-rail 124, and crimping member 126. Of these four components, only blade-rail 124 is stationary relative to the wheel 102. FIGS. 5 and 6 illustrate the arrival of a handle 128 at location 16. Here, an interior section of handle 128 inward of barb head 130 is received into clamping base 120 and clamping arm 122. Barb head 130 is thereby simultaneously positioned between blade-rail 124 and the crimping member 126, which is in its outward, extended position. This aligns barb head score 132 with upper edge 134 of blade-rail 124. Thereafter, as shown in FIG. 7, the rotation of wheel 102 operates the interior cams to bring clamping base 120 and clamping arm 122 together to form clamping unit 123. In this way, handle 128 is securely gripped. Subsequently, crimping member 126 begins to retract axially. As member 126 descends through a plane marked by blade-rail upper edge 134, fingers 136 and 138 of crimping member 126 apply pressure to "break" score 132. Barb head 130 is thereby crimped.

Figure 8:
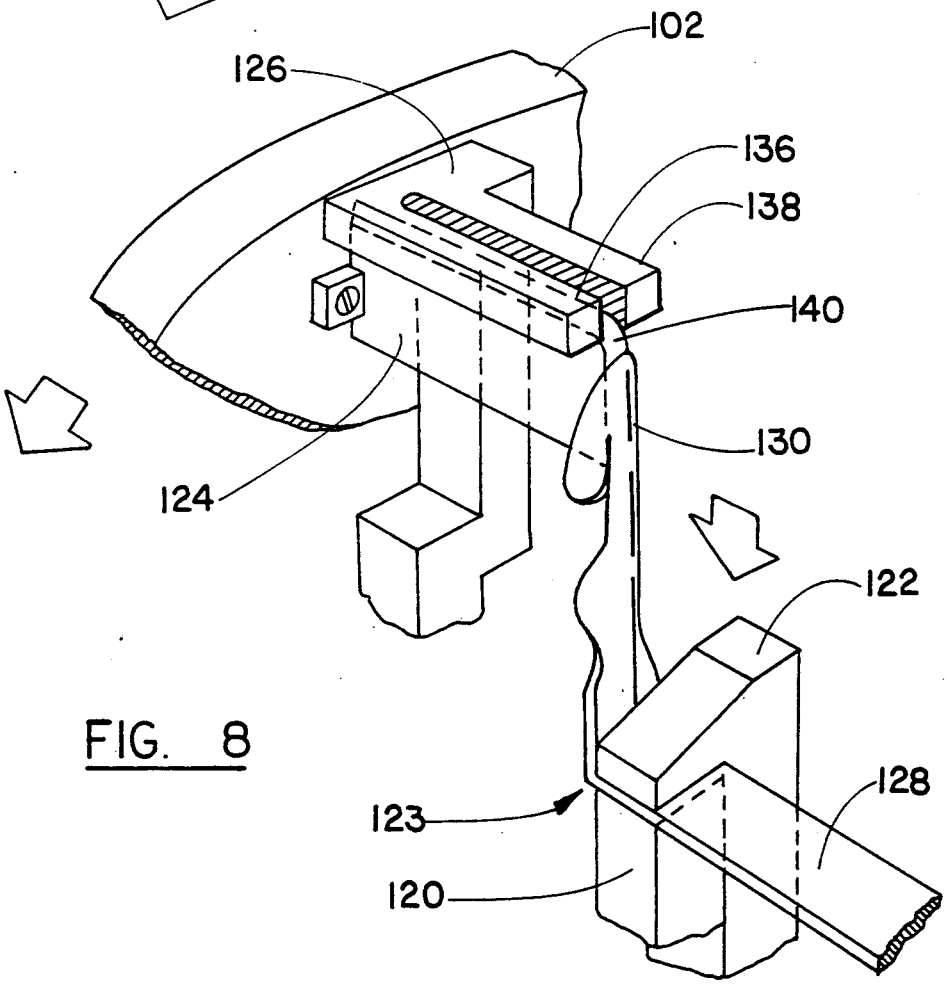

Next, as shown in FIG. 8, the continued rotation of wheel 102 causes clamping unit 123 to axially retract. This movement draws barb head 130 onto blade-rail axial edge 140. Thus, barb head 130 is bent to be perpendicular to the remainder of handle 128 and projecting axially away from the center of wheel 102.

Figure 9:
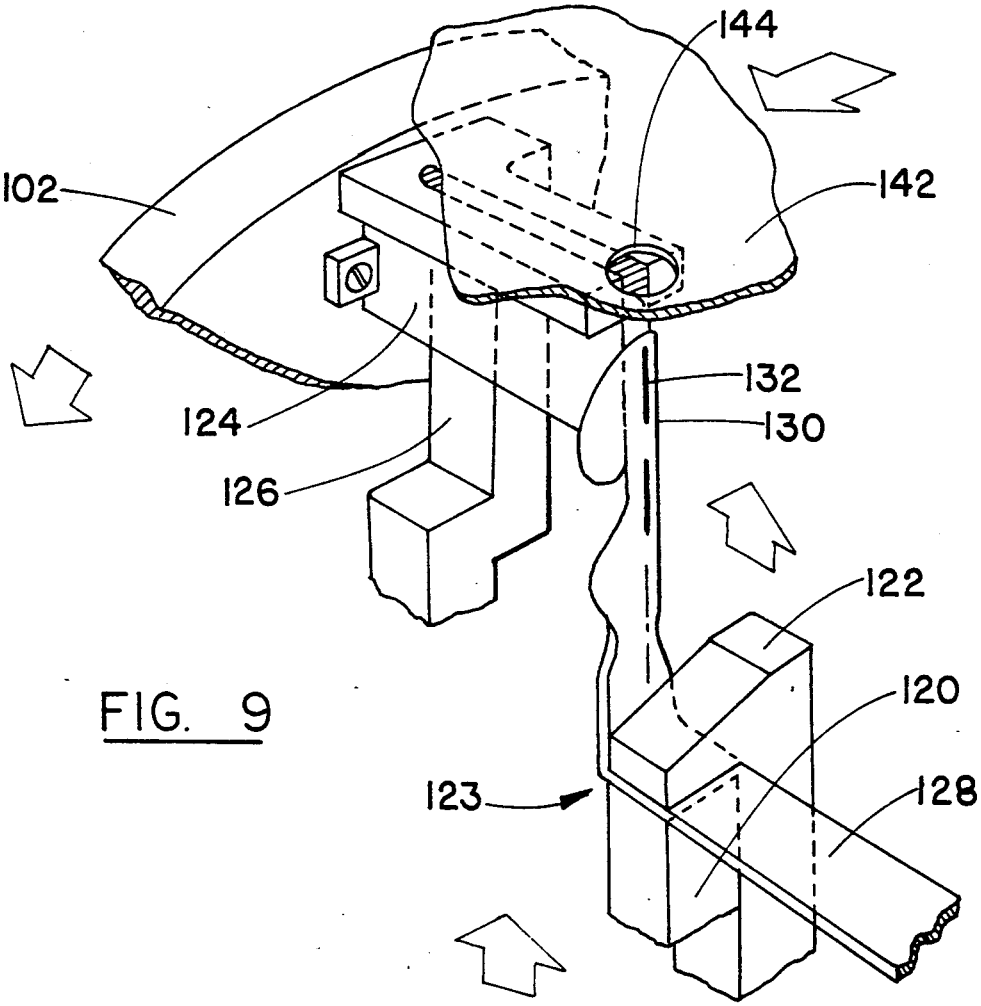
Figure 10:
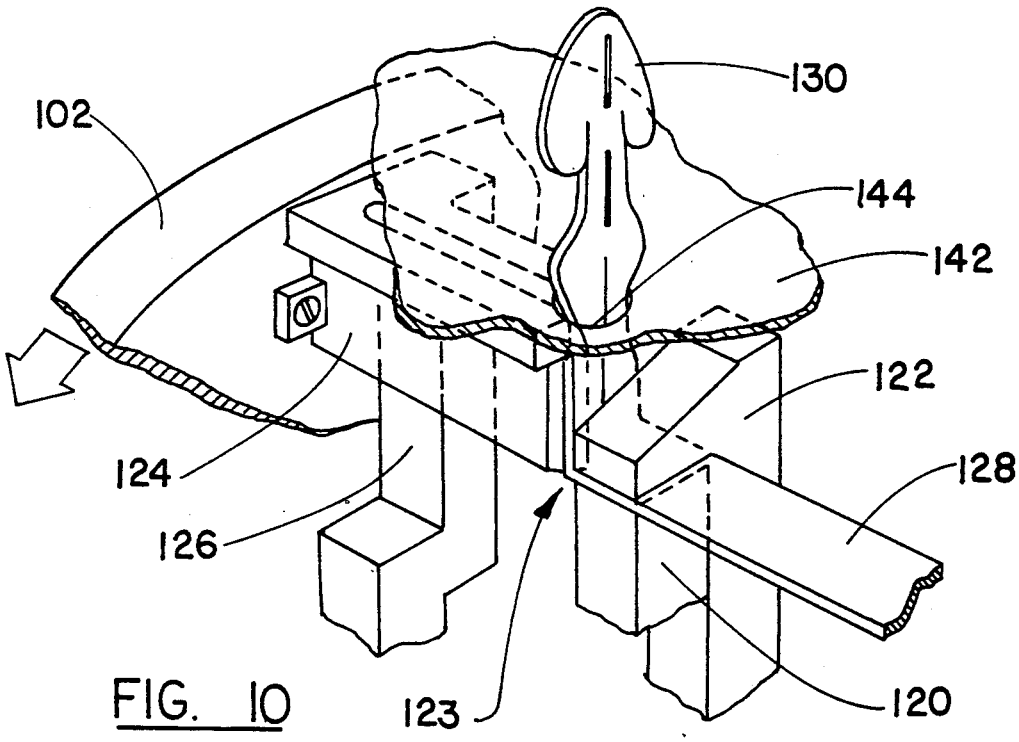

Referring to FIGS. 9 and 10, wheel 102 continues to rotate past location 22 where carton blank 142 has been received. Subsequently, clamping unit 123 begins to extend axially, thereby pushing barb head 130 through handle insertion aperture 144. The crimp in barb head 130 assists insertion by allowing for slightly less precision in alignment. Higher insertion rates are thereby attainable.

Figure 11:
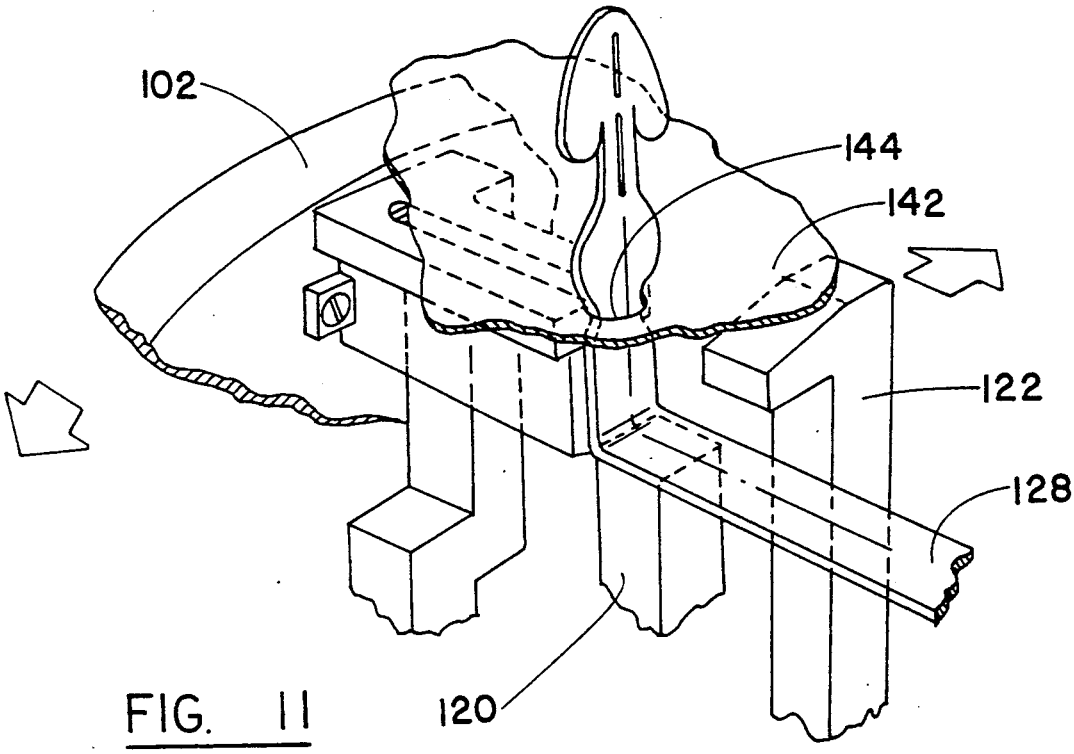

Finally, as shown in FIG. 11, wheel 102 rotates into position 36. Base 120 and arm 122 open and, further, arm 122 pivots such that the two components are no longer contiguous. Handle 128 is thereby released. Simultaneously, the other barb head (not shown) of handle 128 is similarly inserted by the gripper (not shown) parallel to gripper 110. Thus, handle attachment is effectuated.

The invention provides a continuous, virtually trouble-free production rate of at least 200 packages per minute. Furthermore, a rate of nearly 700 packages per minute may be maintained for shorter periods of time. This is in contrast with prior art riveting machines which have had difficulty maintaining a production rate of 100 packages per minute. Thus, it can be seen that a novel and useful apparatus and process for the assembly of a bayonet handle package have been provided. Many variations will become apparent to one of skill in the art from a reading of the above description. Such modifications are within the spirit and scope of this invention as defined by the following appended claims.

That which is claimed is:

1. An apparatus for releasably gripping and bending an elongated bayonet handle having a first barb head defining a first end thereof and an opposite second barb head defining a second end thereof whereby said handle may be attached to a carton blank having a pair of handle insertion apertures, said apparatus comprising:

a horizontal rotatable shaft;

means for rotating said shaft;

at least one wheel mounted on said shaft; and a plurality of circumferentially mounted and evenly spaced cyclically operable handle clamping and insertion assemblages mounted on said wheel for gripping said handle at an interior section of said handle inwardly of said barb heads and for bending said handle such that said barb heads are perpendicular to said interior of said handle and projecting axially away from said wheel, to position said handle for insertion of said barb heads into said apertures.

2. The apparatus constructed in accordance with claim 1 wherein each said assemblage comprises a pair of parallel handle grippers.

3. The apparatus constructed in accordance with claim 1 having two parallel wheels mounted on said rotatable shaft and wherein each said assemblage comprises a pair of parallel handle grippers, one gripper of each pair being mounted on one of the two parallel wheels and another gripper of each pair being mounted on another of the two parallel wheels.

4. The apparatus constructed in accordance with claim 2 wherein each said gripper comprises a blade-rail, a crimping member, a clamping arm and a clamping base.

5. A continuous-motion apparatus for the attachment of an elongated carrying handle having a first barb head defining a first end thereof and an opposite second barb head defining a second end thereof to a carton blank having a pair of handle insertion apertures, said apparatus comprising:

a horizontal rotatable shaft;

handle insertion means comprising at least one wheel mounted on said shaft;

a plurality of circumferentially mounted and evenly spaced cyclically operable handle clamping and insertion assemblages mounted on said wheel for gripping an interior section of said handle inwardly of said barb heads for bending said handle such that said barb heads are perpendicular to said interior of said handle and projecting axially away from said wheel;

means for rotating said shaft;

means for continuously and singularly transporting handles to a first location proximate and tangent said wheel for being received into and gripped by one of said clamping and insertion assemblages as the assemblage rotates past said first location;

means for continuously and singularly transporting carton blanks to a second location proximate and tangent said wheel such that said handle insertion apertures will be properly aligned to receive said bent and projecting barb heads as said assemblage with said handle received therein rotates past said second location; and, timing means for controlling said means for rotating said shaft, said means for transporting said handles, and said means for transporting said carton blanks, whereby an assemblage on the rotating wheel grips a handle at said first location and thereafter bends the barb heads as the assemblage rotates toward said second location wherein said assemblage and said carton blank converge and said barb heads are thereafter inserted into said apertures, said assemblage subsequently releasing said handle thereby providing a carton blank with a handle attached thereto.

6. The apparatus according to claim 5 further comprising means controlled by said timing means for singularly transporting liners to a third location proximate and tangent said wheel and including means for applying adhesive to said carton blank such that said liners can adhesively marry at said third location with said carton blank having said handle attached thereto.

7. The apparatus according to claim 5 wherein said means for transporting said handles comprises a handle dispenser and a handle conveyor.

8. The apparatus according to claim 5 wherein said means for transporting said carton blanks comprises a feeder and a conveyor.

9. The apparatus according to claim 6 wherein said means for transporting liner blanks comprises a feeder and a conveyor.

10. The apparatus according to claim 6 further comprising a handle reject conveyor, a carton blank reject conveyor and a liner reject conveyor.

11. A continuous-motion apparatus for the attachment of an elongated carrying handle having a first barb head defining a first end thereof and an opposite second barb head defining a second end thereof to a carton blank, said apparatus comprising:

a horizontal rotatable shaft;

handle insertion means comprising at least one wheel mounted on said shaft, said wheel having a plurality of circumferentially mounted and evenly spaced cyclically operable handle clamping and insertion assemblages for gripping an interior section of said handle inward said barb heads and further for bending said handle such that said barb heads are perpendicular to said interior of said handle and projecting axially away from said wheel;

means for rotating said shaft;

a handle dispenser for providing a source of singular handles;

a handle conveyor for continuously transporting said handles from said handle dispenser to a first location proximate and tangent said wheel for being received into and gripped by one of said clamping and insertion assemblages as said assemblage rotates past said first location;

a carton blank feeder for providing a source of singular carton blanks;

means for forming a pair of handle insertion apertures in said carton blanks;

a carton blank conveyor for continuously transporting said singular carton blanks from said carton feeder to a second location proximate and tangent said wheel such that said handle insertion apertures will be properly aligned to receive said bent and projecting barb heads as said assemblage with said handle received therein rotates past said second location;

timing means for controlling said means for rotating said shaft, said handle timing chain, and said carton blank conveyor, whereby an assemblage on the rotating wheel grips a handle at said first location and thereafter bends the barb heads as the assemblage rotates toward said second location wherein said assemblage and said carton blank converge and said barb heads are thereafter inserted into said apertures, said assemblage subsequently releasing said handle thereby providing a carton blank with a handle attached thereto.

12. The apparatus according to claim 11 wherein said means for forming a pair of handle insertion apertures in said carton blank is a rotary aperture punch mechanism controlled by said timing means and located above said conveyor, said mechanism having at least one pair of aperture punch pegs thereon whereby the rotation of said pegs into a carton blank thereunder removes an inner section of a perforated area, thereby forming said aperture.

13. The apparatus according to claim 11 further comprising a liner feeder for providing a source of singular liners, a liner conveyor for continuously transporting said singular liners to a third location proximate and tangent said wheel, and means for applying adhesive to said carton blank, whereby said liner can adhesively marry at said third location with said carton blank having said handle attached thereto, said liner feeder and said liner conveyor controlled by said timing means.

14. The apparatus according to claim 13 further comprising a handle reject conveyor, a carton blank reject conveyor and a liner reject conveyor.

15. The process of attaching an elongated bayonet handle having a first barb head defining a first end thereof and a second barb head defining a second end thereof to a carton blank having a pair of handle insertion apertures comprising the steps of:

(a) providing an apparatus comprising:

a horizontal rotatable shaft;

means for driving said shaft;

at least one wheel mounted on said shaft, said wheel having a plurality of circumferentially mounted and evenly spaced handle clamping and insertion assemblages cyclically operable by wheel rotation and capable of gripping an interior section of said handle inward of said barb heads and further capable of bending said handle such that said barb heads are perpendicular to said interior of said handle and projecting axially away from said wheel;

(b) rotating said wheel;

(c) moving a handle to a first location proximate and tangent said wheel whereby one of said assemblages will converge upon and grip said handle as said assemblage rotates past said first location and thereafter said assemblage will bend said barb heads;

(d) moving a carton blank to a second location proximate and tangent said wheel whereby said assemblages gripping said bent handle will converge upon said carton blank and said barb heads will thereafter be inserted into said apertures and said handle will be attached to said carton blank.

16. The process according to claim 15 further comprising the steps of:

(e) applying adhesive to said carton blank; and, (f) flatly attaching a liner to said carton blank after the attachment of said handle and application of said adhesive thereto.

* * * * *

UNITED STATES PATENT AND TRADEMARK OFFICE

CERTIFICATE OF CORRECTION

PATENT NO. : 5,095,683

DATED : March 17, 1992

INVENTOR(S) : J.T. Roberts, C.E. Monsees, L.J. Mattson, R.S. Goldstein
R.H. Wanless, R.O. Simpson It is certified that error appears in the above-identified patent and that said Letters Patent is hereby corrected as shown below:

Column 2, line 29, "tripping" should read -- gripping -- .

Column 2, line 50, "there" should read -- three -- .

Signed and Sealed this

Twelfth Day of October, 1993

*Attest:*

*Attesting Officer*

BRUCE LEHMAN

*Commissioner of Patents and Trademarks*